US007850796B2

(12) United States Patent
Inukai et al.

(10) Patent No.: US 7,850,796 B2
(45) Date of Patent: Dec. 14, 2010

(54) ALUMINUM ALLOY FIN MATERIAL FOR BRAZING

(75) Inventors: Kyoji Inukai, Kariya (JP); Tomohiro Ito, Kariya (JP); Akira Kawahara, Tokyo (JP); Akio Niikura, Tokyo (JP)

(73) Assignees: Denso Corporation, Kariya-shi (JP); Furukawa-Sky Aluminum Corp., Tokyo (JP)

( * ) Notice: Subject to any disclaimer, the term of this patent is extended or adjusted under 35 U.S.C. 154(b) by 175 days.

(21) Appl. No.: 11/892,147

(22) Filed: Aug. 20, 2007

(65) Prior Publication Data

US 2009/0053549 A1 Feb. 26, 2009

(51) Int. Cl.
*C22C 21/00* (2006.01)
*C22C 21/04* (2006.01)

(52) U.S. Cl. ..... 148/437; 148/552; 420/548; 420/550

(58) Field of Classification Search ..... 420/528–554; 148/437–440, 549–552
See application file for complete search history.

(56) References Cited

U.S. PATENT DOCUMENTS

| | | | |
|---|---|---|---|
| 2003/0015573 | A1 | 1/2003 | Kawahara et al. |
| 2004/0028940 | A1 | 2/2004 | Toyama et al. |

FOREIGN PATENT DOCUMENTS

| | | | | |
|---|---|---|---|---|
| JP | 57031468 | A | | 2/1982 |
| JP | 08143997 | A | | 11/1994 |
| JP | 07216485 | A | | 8/1995 |
| JP | 08104934 | A | | 4/1996 |
| JP | 08143998 | A | | 6/1996 |
| JP | 11131166 | A | | 5/1997 |
| JP | 2002256402 | A | | 9/2002 |
| JP | 2003-34851 | A | | 2/2003 |
| JP | 2005139505 | A | * | 6/2005 |
| WO | 0005426 | A1 | | 2/2000 |
| WO | 0153552 | A1 | | 7/2001 |
| WO | 2005069779 | A2 | | 8/2005 |

OTHER PUBLICATIONS

Machine translation of JP 2005139505 A.*
European Search Report dated Aug. 30, 2006, issued in corresponding European application 06003274.
Concise explanation of documents for JP-A-7-216485, JP-A-8-104934 and JP-A-2002-256402.
Japanese Office Action dated Jul. 27, 2010, with Notice of Reasons for Rejection, in JP Patent Application No. 2005-041207.

* cited by examiner

*Primary Examiner*—Scott Kastler
*Assistant Examiner*—Brian Walck
(74) *Attorney, Agent, or Firm*—Westerman, Hattori, Daniels & Adrian, LLP

(57) ABSTRACT

An aluminum alloy fin material for brazing, characterized by comprising an aluminum alloy comprising more than 1.4% by mass but not more than 1.8% by mass of Fe, 0.8% by mass or more but 1.0% by mass or less of Si, and more than 0.6% by mass but not more than 0.9% by mass of Mn, with the balance being Al and inevitable impurities, wherein 80% or more of the surface area, as viewed from the surface layer of the fin plane, is occupied by recrystallized grains with a length of 10 mm or more, in a direction rolled.

4 Claims, 3 Drawing Sheets

ALUMINUM ALLOY FIN MATERIAL FOR BRAZING

FIELD OF THE INVENTION

The present invention relates to an aluminum alloy fin material, for brazing, that is excellent in mechanical strength, heat conductance, and formability into corrugated fins, while thinning of the fin is possible.

BACKGROUND OF THE INVENTION

Fin materials to be used for automobile heat exchangers, such as radiators, by brazing, are formed into corrugated shapes, and are assembled with tube materials, and are then bonded by brazing. Needs for light weight and cost reduction of heat exchangers are ever-increasing in recent years, and thinning of major members, including the fin material, is advancing further. To maintain or improve characteristics of the heat exchanger when the fin material is thinned, various elements have been added to the fin material, or the manufacturing process has been studied, in recent years, to enhance the mechanical strength of the fin material.

As examples for changing elements to be added, fin materials of Al—Fe—Ni-series alloys are proposed (see, for example, JP-A-7-216485 ("JP-A" means unexamined published Japanese patent application) and JP-A-8-104934). However, since the fin materials described in these publications are poor in self-corrosion resistance, the materials are alloys not suitable to be made into a thin fin, although they are excellent in mechanical strength and heat conductivity. As examples of a production process studied, there are proposed fin materials of Al—Fe—Mn—Si-series alloys, for enhancing the mechanical strength and electrical conductivity, by specifying the cooling rate in a continuous casting and rolling process (see, for example, International Patent Application Publication No. WO00/05426). However, as described in WO00/05426, the recrystallized grain diameter of the raw material for this fin material is extremely small. Due to the above extremely small size, the resulting fin material may often be buckled by diffusion of a filler alloy element(s) during brazing, and the material is not suitable to be made into a thin fin.

Further, there is proposed a fin material having high strength and high heat conductivity, by using twin-roll continuous casting and rolling (see, for example, JP-A-2002-241910). Resistance to diffusion of the filler alloy is enhanced in this fin material by maintaining a rolled texture or structure (a fibrous structure) until heating at near a brazing temperature. However, because the amount of spring back is so large in recently developed highly strengthened and thinned fin materials, a desired fin pitch cannot be obtained by forming into a corrugated shape in some cases.

Accordingly, it is proposed to recrystallize aluminum alloys by intermediate annealing to reduce the amount of spring back, thereby to reduce proof stress of the material. However, the bonding ratio by brazing may be reduced in this case, since the filler alloy is diffused as described above when the recrystallized structure is fine, or, on the contrary, the peak height of the corrugated fin (the height from an R portion at a trough to an R portion at the neighboring peak of the corrugated fin) becomes irregular when the recrystallized structure is large in a certain extent. Irregularity of the height of the fin peak will be described in detail in below.

Further, there are proposed fin materials excellent in mechanical strength after brazing; heat conductivity, self-corrosion resistance, and erosion resistance, but nothing is mentioned about formability into corrugated shape (see, for example, JP-A-2002-256402). That is, although a final cold-rolling ratio is 15 to 50% in the claim in the patent publication above, it is apparent that the strength of the material and the configuration of the crystal structure at a final cold-rolling ratio of 15% are largely different from those at a final cold-rolling ratio of 50%. This is because the formability into a corrugated fin shape has not been taken into account. In addition, continuous annealing of less than one minute is used in the intermediate annealing process in each of the examples in JP-A-2002-256402. Although continuous annealing is used up to a sheet thickness of 0.11 mm when the process is counted back from the final sheet thickness and final cold-rolling ratio, this process may be considered to be a quite difficult process using conventional industrial facilities, and only a limited number of facilities can conduct it. Contrary, in a usual continuous annealing furnace, it is assumed that annealing is applied in a range of sheet thickness of 0.3 to 1.0 mm, from the viewpoint of cost and performance. For example, when a sheet of thickness 0.3 mm is continuously annealed, followed by cold rolling to 0.08 mm, the final cold-rolling ratio exceeds 70%, and it is quite highly possible to cause spring back during a process for forming corrugated fins, and erosion may occur in the brazing process.

Other and further objects, features and advantages of the invention will appear more fully from the following description, taken in connection with the accompanying drawings.

SUMMARY OF THE INVENTION

As described above, fin materials having high mechanical strength and high heat conductivity, which satisfy erosion resistance and further formability into corrugated shape, which are essential in thinning the fin material, have not been developed hitherto. Accordingly, an object of the present invention is to provide a fin material for an aluminum alloy heat exchanger, which fin material has high strength after heating for brazing, and which fin material is excellent in formability before heating for brazing, and excellent in resistance against erosion of a filler alloy.

The present inventors, having made intensive studies on aluminum alloys suitable for solving the problems as described above, found that excellent aluminum alloy fin materials could be obtained by specifically evaluating the alloy compositions and recrystallized structure of the material.

According to the present invention, there is provided the following means:

(1) An aluminum alloy fin material for brazing, characterized by comprising an aluminum alloy comprising more than 1.4% by mass but not more than 1.8% by mass of Fe, 0.8% by mass or more but 1.0% by mass or less of Si, and more than 0.6% by mass but not more than 0.9% by mass of Mn, with the balance being Al and inevitable impurities, wherein 80% or more of the surface area, as viewed from the surface layer of the fin plane, is occupied by recrystallized grains with a length of 10 mm or more, in a direction rolled.

In the present invention, the kind and size of dispersed grains of a second phase are controlled, by specifying the composition of the alloy. This enables improving the tensile strength and electrical conductivity of the fin material after heating corresponding to brazing. In addition, in the present invention, specifying the crystal structure permits formability of the fin materials, whose accuracy for forming corrugated fins has been difficult to enhance due to advanced thinning, to be improved. Although the crystal structure as defined in the present invention cannot be obtained without specifying the alloy composition, a proper production process may be required in addition to the specific alloy composition. The crystal structure can be simply confirmed by etching with aqua regia (nitrohydrochloric acid).

In the fin material for brazing thus obtained, characteristics required for thinning the fin material are improved, including such characteristics as tensile strength after brazing, heat conductivity, melt resistance of the fin material, and formability into corrugated shape. Accordingly, the present invention provides industrially remarkable effects by enabling fin materials to be thinned.

DETAILED DESCRIPTION OF THE INVENTION

Figure 1:
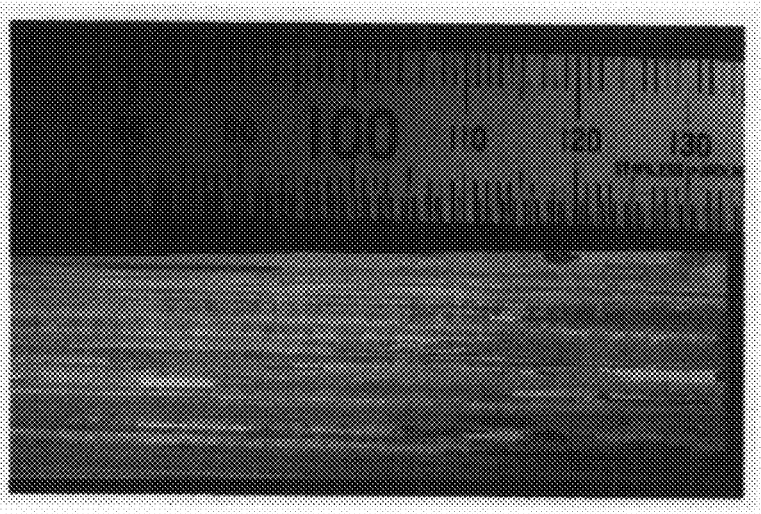
FIG. 1 is a photograph of an example showing the recrystallized structure of the surface of the fin material according to the present invention.

Preferred embodiments of the aluminum alloy fin material for brazing according to the present invention will be described in detail hereinafter.

First, in the present invention, the reason the composition of the aluminum (Al) alloy is defined as described above will be described below.

In the present invention, an object is to obtain an Al alloy having a coarse or giant recrystallized structure, by finely dispersing an Al—Fe—Mn—Si-series intermetallic compound(s), which exhibits an action or effect for blocking dislocation and subgrain boundary from migrating during the intermediate annealing process. Iron (Fe), silicon (Si) and manganese (Mn), as essential elements, each are added to improve the strength of the fin material after brazing, and to obtain a fine intermetallic compound(s).

In the alloy according to the present invention, the content of Fe is more than 1.4% by mass but not more than 1.8% by mass, preferably more than 1.5% by mass but less than 1.7% by mass. When the content of Fe is too small, the mechanical strength is not sufficiently improved; and when too large, the recrystallized structure becomes too fine since crystallized phases are coarsened and nucleation sites for recrystallization increases. Further, corrosion resistance of the fin material is apt to be poor.

The content of Si is 0.8% by mass to 1.0% by mass. When the amount of addition of Si is too small, most of the intermetallic compound(s) form an Al—Mn-series compound(s). Although the compound(s) is fine and effective for coarsening the recrystallized grains by heating, the strength of the fin material after heating for brazing becomes poor since most of the intermetallic compound(s) is dissolved again into the mother phase to form a solid solution by heating for brazing. On the other hand, when the amount of Si is too large, the melting point of the alloy lowers, and the fin material is buckled by diffusion of the filler alloy when the alloy is used for the fin material for brazing.

The content of Mn is more than 0.6% by mass but not more than 0.9% by mass, preferably more than 0.65% by mass but less than 0.8% by mass. When the amount of addition of Mn is too small, the amount of Al—Fe—Si-series intermetallic compound increases. Since the Al—Fe—Si-series intermetallic compound is coarser than the Al—Fe—Mn—Si-series intermetallic compound, the recrystallized structure is insufficiently coarsened. Further, strength after heating for brazing cannot be sufficiently improved. On the contrary, when the amount of addition of Mn is too large, heat conductivity and rollability become poor.

Further, to the Al alloy constituting the fin material of the present invention, addition may be made of, in addition to the above essential elements, one or at least two of zinc (Zn), indium (In) and tin (Sn), having a sacrificial anode effect, or/and one or at least two of copper (Cu), titanium (Ti) and zirconium (Zr), effective for enhancing mechanical strength. Since addition of Zn, In, and/or Sn provides the sacrificial anode effect, as well as deterioration of the fin material's self-corrosion resistance, the upper limits are generally 3.0% by mass for Zn, 0.3% by mass for In, and 0.3% by mass for Sn. When a large amount of the reinforcing element(s) described above is added, heat conductivity, corrosion resistance and sacrificial anode effect of the fin material after heating for brazing are deteriorated by adding Cu or/and Ti, and rollability and fatigue characteristics are deteriorated by adding Zr. Therefore, when any of these elements is to be added, the preferable upper limit is 0.25% by mass for Cu, 0.1% by mass for Ti, and 0.1% by mass for Zr.

In addition to the elements above, any of other elements (e.g. Ni, Cr and Co) for further fining the compound may be added to the fin material of the present invention. When any of these elements is to be added, the preferable upper limit of the element to be added is 0.2% by mass, from the viewpoint of corrosion resistance and controllability of the crystal structure of the fin material.

Next, the reason the present invention specifies that "80% or more of the surface area, as viewed from the surface layer of the fin plane, is occupied by recrystallized grains with a length of 10 mm or more, in a direction (that is) rolled" will be described below.

Herein, the term "surface area, as viewed from the surface layer of the fin plane" means the surface area as viewed with the naked eye from a plane perpendicular to the direction of sheet thickness of the fin material (LT-ST plane), and the size (length and width) of the fin material may be arbitrary. The size may be either the width of a strip of a product subjected to slitter processing, or the total width of the rolled sheet before slitter processing. The width of the strip of the product is preferable for the convenience of measurements, but the results are the same even by measuring any size.

Figure 2:
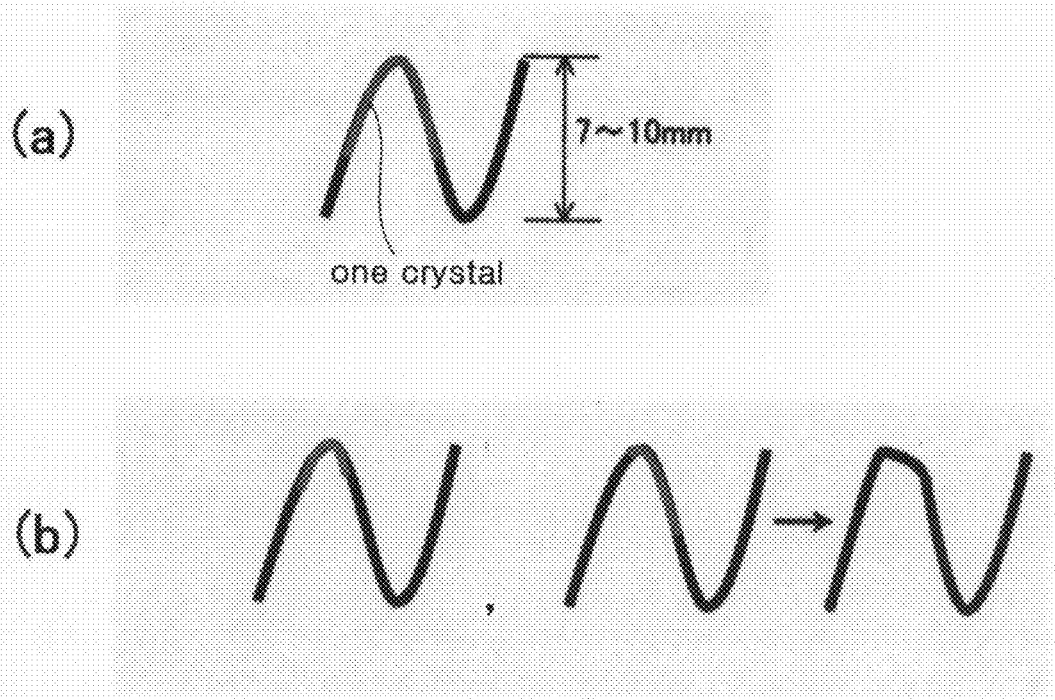
FIG. 2 is an explanatory diagram showing forming into a corrugated shape, in which FIG. 2(*a*) illustrates an example according to the present invention showing that a regularly corrugated shape can be formed, and FIG. 2(*b*) illustrates a conventional example showing that the height of the fin becomes irregular.

The present inventors have observed the plane of the fin material after forming respective fin materials having various crystal grain diameters. The observation showed that the probability for allowing crystal grain boundaries to locate at the portions of the rounded (R) peaks after forming a corrugated sheet is extremely reduced, when the recrystallized structure has the length of 10 mm or more in the direction rolled, since the height of the peak of the fin in the heat exchangers developed in recent years is about 7 to 10 mm. As shown in FIG. 2(*b*), the fin is broken at the crystal grain boundary during the process for forming the corrugated fin when the crystal grain boundary locates at the vicinity of the portion of the rounded peak, to consequently cause irregular height of the peak of the fin. Contrary to the above, as shown in FIG. 2(*a*), the fin is not deformed when there are no crystal grain boundaries at the rounded peak portions. It was revealed that about 80% or more, preferably 85% or more, of the surface area of the surface layer of the fin plane should include such crystal structure of coarse recrystallized grains, to obtain the effect as described above.

To observe the crystal structure on the fin material plane surface layer, the alloy fin material obtained is immersed in aqua regia, and the surface of the sheet material may be directly observed. Observation with the naked eye is sufficient for observing such a coarse crystal structure according to the present invention. Since the crystal grain coarsened in the direction rolled generally contains only one or two crystal grains in the direction of sheet thickness, they may be observed on the surface layer. In the present invention, 80% or more, preferably 85% or more, of the surface area, as observed from the surface layer, is preferably occupied by the recrystallized grains with a length of 10 mm or more, preferably 10 to 80 mm, and more preferably 10 to 40 mm, in the direction rolled. The upper limit of the aforementioned surface area, as observed from the surface layer, which is occupied by the recrystallized grains with a length of 10 mm or more, is not particularly limited, but it is preferably 100% or less.

FIG. 1 shows a photograph of the crystal structure from the plane surface layer, as an example of the fin material of the present invention. The minimum unit of the scale is 1 mm, and the size of the recrystallized grains is measured in the direction rolled (in the horizontal direction in the photograph). As shown in the figure, almost all of the area of the surface layer is occupied with crystal grains having a length of about 15 mm or more.

Figure 3:
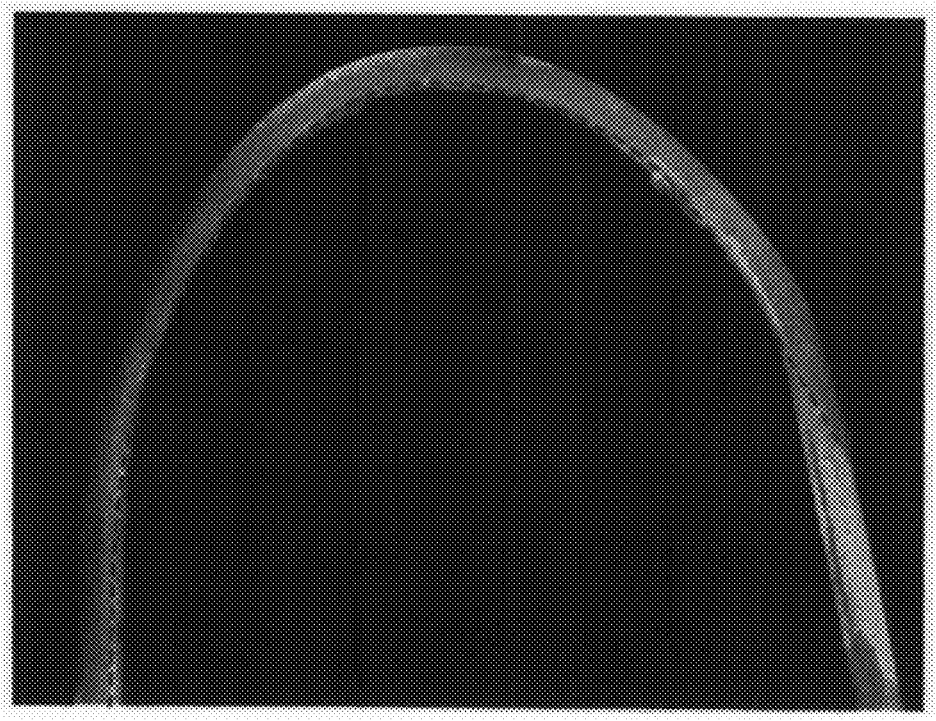
FIG. 3 is a photograph of an example of the recrystallized structure in the cross section of a rounded (R) portion of the fin material according to the present invention.

FIG. 3 shows an example of the crystal structure photograph in the cross section of a rounded portion of the corrugated sheet formed from the fin material obtained in an example according to the present invention. As shown in the photograph in FIG. 1, since the length of the crystal grain is as large as 10 mm or longer in the fin material obtained in the example according to the present invention, the crystal grain boundary (shown by the dotted line in the photograph) does not locate at the rounded portion, as shown in FIG. 3, and the fin material is favorably corrugated.

Figure 4:
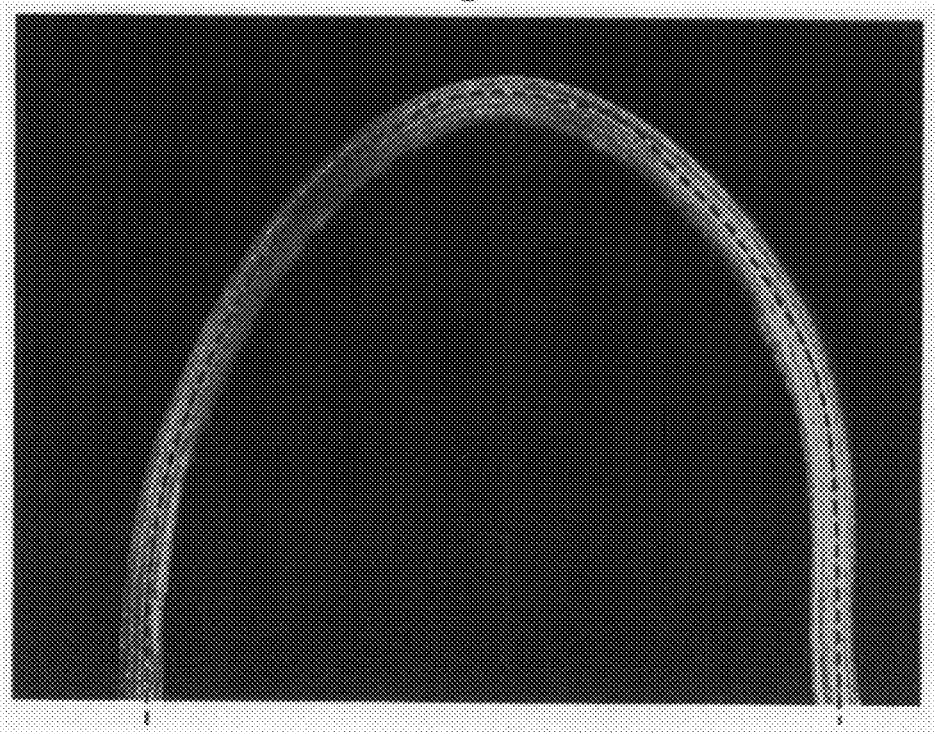
FIG. 4 is a photograph of an example of the recrystallized structure in the cross section of a rounded (R) portion of the fin material according to a conventional example.

FIG. 4 is an example of the crystal structure photograph in the cross section of a rounded portion of the fin material, as a kind of conventional fin material having a completely fibrous structure of the crystal grain. Similar to the above, in the case of the complete fibrous structure, the crystal grain boundary is not located at the rounded portion, as shown in FIG. 4, since the crystal grain is generally long, and the fin material is favorably corrugated. However, the strength of the material increases due to a low occupation ratio of the aforementioned specific crystal grain in the surface area, when an alloy fin material highly reinforced to be thinned as described above is produced from an alloy having such a completely fibrous structure. Accordingly, it is assumed that the fin material cannot be favorably formed into a corrugated sheet as shown in FIG. 4, when the size R of the rounded portion is reduced for thinning the fin or miniaturizing the resulting heat exchanger, as compared with the example shown in FIG. 4.

Figure 5:
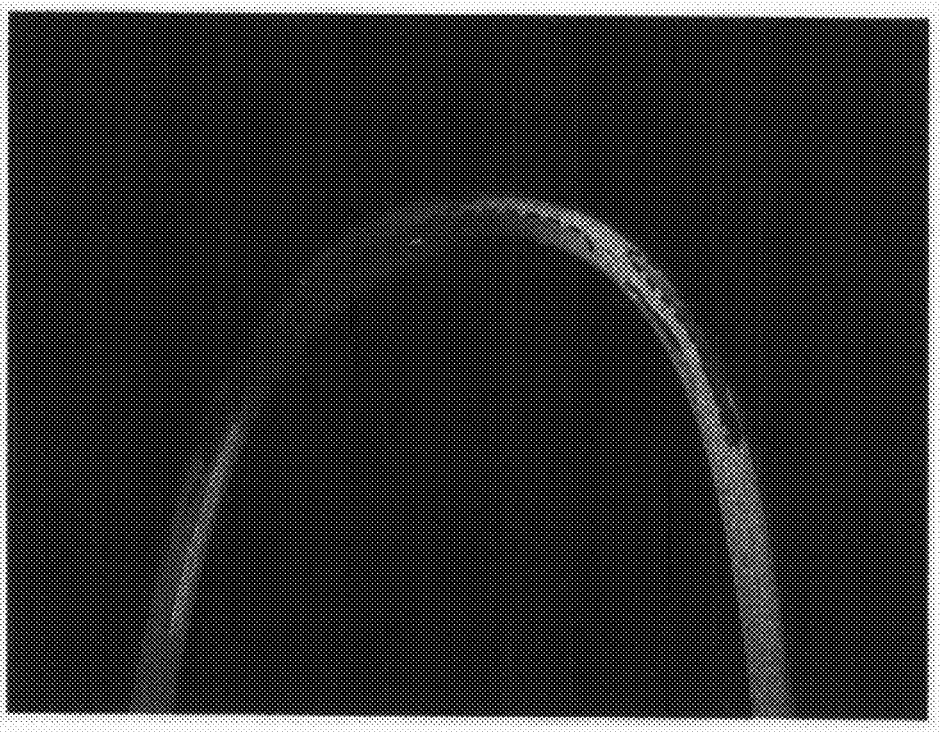
FIG. 5 is a photograph of another example of the recrystallized structure in the cross section of a rounded (R) portion of the fin material according to another conventional example.
Figure 6:
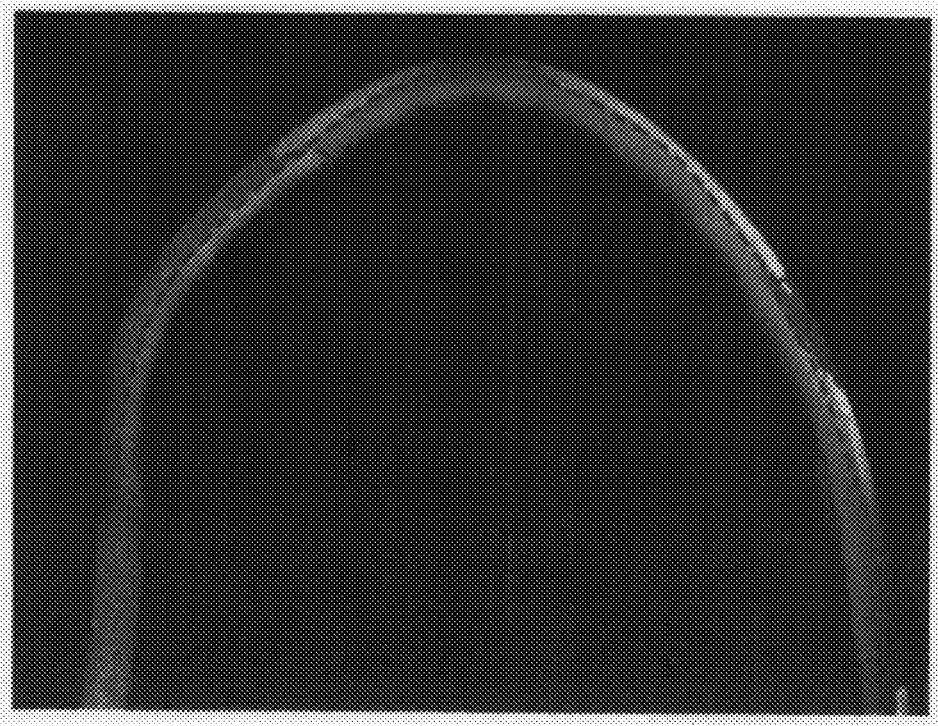
FIG. 6 is a photograph of the aforementioned another example of the recrystallized structure in the cross section of a rounded (R) portion of the fin material according to the aforementioned another conventional example.

FIGS. 5 and 6 shows examples of photographs of the cross sections of the rounded portions observed at different sites of an identical fin material, which is a kind of conventional fin material, almost having crystal structure with a size of less than 10 mm. The crystal grain boundaries are located at the vicinity of the rounded portion, at high probability, at the site shown in FIG. 6, and consequently the fin is buckled at the vicinity of the rounded portion R, as shown in FIG. 6. Therefore, a desired shape of the fin cannot be obtained throughout the fin in the conventional fin material.

Next, an example of the method for producing the aluminum alloy fin material of the present invention will be described below.

Since a fine intermetallic compound(s) as described above is densely dispersed in the Al alloy having the elements and composition ratio as defined in the present invention, the recrystallized crystal grain is coarsened after the final intermediate annealing.

For example, the fin material can be produced by the steps including: melting the Al alloy having the element composition described above; casting the thus-molten alloy by a twin-roll continuous casting and rolling method; winding the thus-cast and rolled alloy into a form of coil; cold-rolling the wound alloy in a usual manner; and applying final intermediate annealing at 300 to 480° C. for 30 to 1,500 minutes, followed by cold rolling.

The fin material of the present invention which can be thus obtained is excellent not only in various characteristics, especially in high strength, after heating for brazing, but also in resistance to diffusion of the filler alloy during heating for brazing and in formability into a corrugated shape before heating for brazing. Such the entire characteristics may be attained, by controlling the alloy composition as well as the configuration of the recrystallized structure of the fin material after rolling, thereby providing a sufficient size of the recrystallized grain that hardly permits diffusion of the filler alloy, and further providing a length of the recrystallized grain enough for preventing their grain boundaries from occurring at the rounded peak portions, which can be deduced from the height of the fin peak.

The present invention will be described in more detail based on examples given below, but the invention is not meant to be limited by these.

EXAMPLES

Examples According to this Invention and Comparative Examples

A fin material of sheet thickness 0.06 mm was produced by the steps including: melting an Al alloy having the metal elements and composition ratios (% by mass), as shown in Table 1; casting the thus-molten alloy by a twin-roll continuous casting and rolling method; winding the thus-cast and rolled alloy into a shape of coil; cold-rolling the wound alloy to a sheet thickness of 0.08 mm; subjecting the cold-rolled alloy to final intermediate annealing at 400° C. for 120 minutes; and cold-rolling to the sheet thickness of 0.06 mm.

TABLE 1

| | Alloy No. | Fe | Si | Mn | Zn | In | Sn | Cu | Ti | Zr | Ni | Cr | Co | Al |
|---|---|---|---|---|---|---|---|---|---|---|---|---|---|---|
| Examples | 1 | 1.45 | 0.95 | 0.75 | — | — | — | — | — | — | 0.10 | 0.08 | — | Balance |
| according to | 2 | 1.60 | 0.90 | 0.70 | 1.10 | — | — | — | — | — | — | — | — | Balance |
| this invention | 3 | 1.50 | 0.95 | 0.90 | 0.55 | 0.01 | 0.01 | — | 0.02 | 0.06 | — | — | 0.03 | Balance |
| | 4 | 1.80 | 0.80 | 0.60 | 2.50 | — | — | 0.16 | — | — | — | — | — | Balance |
| Comparative | 5 | 1.90 | 0.90 | 0.70 | 0.65 | — | — | — | — | — | — | — | — | Balance |
| examples | 6 | 1.35 | 0.90 | 0.70 | 1.00 | — | — | — | 0.02 | 0.06 | 0.05 | — | — | Balance |
| | 7 | 1.65 | 1.10 | 0.70 | — | — | — | — | — | — | — | — | — | Balance |
| | 8 | 1.65 | 0.70 | 0.70 | 1.00 | — | — | — | — | 0.04 | — | 0.04 | 0.02 | Balance |
| | 9 | 1.65 | 0.90 | 1.00 | 1.00 | — | — | — | — | — | — | — | — | Balance |
| | 10 | 1.65 | 0.90 | 0.50 | 1.00 | — | — | 0.12 | — | 0.04 | — | — | — | Balance |

Note:
The values with underlines each show that the compositions were outside of the definition of the present invention.
(Unit: % by mass)

(Tests)

Crystal structures of the fin materials obtained from respective alloys Nos. 1 to 10, produced in Examples according to the present invention, and Comparative examples, were investigated and were subjected to the following evaluation tests.

The rolling fracture is evaluated whether fracture was occurred and observed during the cold rolling.

The crystal structure was examined by observing macro structure with the naked eye, after macro-etching of any of the Al alloy fin materials (200 mm×200 mm) by immersing the surface in aqua regia. The rank "○" (good) of the "crystal structure after rolling" shows that 80% or more of the surface area was occupied by recrystallized grains with a length of 10 mm or longer in the direction rolled, and the rank "x" (poor) shows that less than 80% of the surface area was occupied by recrystallized grains with a length of 10 mm or longer in the direction rolled. The occupation ratio of the recrystallized grains with a length of 10 mm or longer in the surface area was obtained from analysis, using an image analysis tool, after reading the surface of the macro-etched fin material as an image with a computer.

To evaluate droop resistance, the fin material was horizontally supported so that the length of the protruded portion of the fin material would be 50 mm, and the distance or length of droop (mm) was measured after heating the material at 600° C. for ten minutes.

The tensile strength and electrical conductivity of the fin material after heating corresponding to brazing, were evaluated, by measuring the tensile strength and electrical conductivity, after heating the fin material under conditions corresponding to brazing (at 600° C., for four minutes). The tensile strength was measured according to JIS Z 2241, and the electrical conductivity was measured according to JIS H 0505, for each evaluation. The electrical conductivity serves as an index of heat conductivity.

The fin material after cold rolling was slit into a width of 16 mm, and the slit sample of the fin material was set to a corrugating machine such that the distance between fin peaks would be 2.5 mm. Each slit sample of the fin material was then corrugated, to produce a corrugated fin material having 100 peaks and troughs. Regarding the occurrence of irregularity of peak heights, the distance between the peaks was measured, and the number of peaks of the corrugated fin having a distance of 2.5 mm±20% or more was investigated. The corrugated fin material having 10 or more irregular distances between the fin peaks was evaluated as "x" (poor), and other cases were evaluated as "○" (good).

The corrugated fin material was assembled to a tube material of length 100 mm, to produce a mini-core having five steps, by brazing. Occurrence of melting of the fin in this mini-core was investigated by microscopic observation. Core observed melting of the fin was evaluated as "observed" (poor) (see JP-A-2002-241910). When the fin material was broken during cold rolling, the residual part of the alloy was cold-rolled into a fin material using laboratory equipment, and was tested and evaluated.

The results of these investigations and evaluation tests are shown in Table 2 below.

TABLE 2

| | No. | Rolling fracture | Crystal structure after rolling | Distance of droop (mm) | After heating corresponding to brazing: Tensile strength (MPa) | Electrical conductivity (% IACS) | Occurrence of irregularity of peak height | Occurrence of melting of fin |
|---|---|---|---|---|---|---|---|---|
| Examples | 1 | None | ○ | 7 | 132 | 50.9 | ○ | None |
| according to | 2 | None | ○ | 9 | 136 | 50.5 | ○ | None |
| this invention | 3 | None | ○ | 8 | 130 | 49.5 | ○ | None |
| | 4 | None | ○ | 12 | 139 | 50.7 | ○ | None |
| Comparative | 5 | None | X | 19 | 137 | 50.6 | X | Observed |
| examples | 6 | None | ○ | 12 | 118 | 47.5 | ○ | None |
| | 7 | None | ○ | 10 | 134 | 49.5 | ○ | Observed |
| | 8 | None | ○ | 11 | 122 | 48.0 | ○ | None |
| | 9 | Observed | ○ | 12 | 136 | 47.5 | ○ | None |
| | 10 | None | X | 21 | 117 | 52.5 | X | Observed |

As is apparent from Table 2, the samples of Examples Nos. 1 to 4 according to the present invention were able to produce fin materials, without fracture during cold rolling. Further, these samples were excellent in droop resistance, with high tensile strength and electrical conductivity after heating corresponding to brazing, while no melting of the fin was observed. Further, the samples having the crystal structure as defined in the present invention seldom showed irregularity of peak height after corrugation.

Contrary to the above, in the sample of Comparative example 5, it is assumed that the compound phase was coarsened, due to a too large amount of Fe added. Consequently, the number of nucleation sites for recrystallization was increased, and the recrystallized structure was made too fine. As a result, the amount of droop was conspicuously large, to cause melting of the fin. Further, the peak height after corrugation was irregular.

On the other hand, the amount of Fe added was too small in Comparative example 6, and the amounts of crystallization and precipitation of Mn and Si were decreased. Consequently, the tensile strength and electrical conductivity after heating corresponding to brazing were conspicuously low.

In Comparative example 7, since the amount of Si added was too large, the fin was melted upon brazing.

Since the amount of Si added was too small in Comparative example 8, most of the dispersed grains in the second phase formed an Al-Mn-series intermetallic compound(s). The size of the Al—Mn-series intermetallic compound was small, and most of the compound was dissolved again in the matrix phase, forming a solid solution, upon brazing. As a result, the tensile strength and electrical conductivity after heating corresponding to brazing were conspicuously low.

The amount of Mn added was too large in Comparative example 9, and the fin material was fractured during rolling. The electrical conductivity, after heating corresponding to brazing, of the fin material produced from the residual portion, was conspicuously low.

The amount of Mn added was too small in Comparative example 10, and most of the dispersed grains in the second phase formed an Al—Fe—Si-series intermetallic compound(s). Since the Al—Fe—Si-series intermetallic compound was more coarsened than the Al—Fe—Mn—Si-series intermetallic compound, the former served as nucleation sites for recrystallization, to make the recrystallized grains too fine. Consequently, the amount of droop was conspicuously large, to cause melting of the fin. Further, the peak height by corrugation was irregular, and further the tensile strength after heating corresponding to brazing was conspicuously low.

Having described our invention as related to the present embodiments, it is our intention that the invention not be limited by any of the details of the description, unless otherwise specified, but rather be construed broadly within its spirit and scope as set out in the accompanying claims.

What is claimed is:

1. An aluminum alloy fin material for brazing, comprising an aluminum alloy comprising more than 1.4% by mass but not more than 1.8% by mass of Fe, 0.8% by mass or more but 1.0% by mass or less of Si, and more than 0.65% by mass but not more than 0.9% by mass of Mn, with the balance being Al and inevitable impurities, wherein 80% or more of the surface area, as viewed from the surface layer of the fin plane, is occupied by recrystallized grains with a length of 10 mm to 80 mm, in a direction rolled.

2. The aluminum alloy fin material for brazing as claimed in claim 1, wherein 85% or more of the surface area, as viewed from the surface layer of the fin plane, is occupied by recrystallized grains with a length of 10 to 80 mm, in the direction rolled.

3. An aluminum alloy fin material for brazing, comprising an aluminum alloy comprising more than 1.4% by mass but not more than 1.8% by mass of Fe, 0.8% by mass or more but 1.0% by mass or less of Si, and more than 0.65% by mass but not more than 0.9% by mass of Mn, at least one selected from the group consisting of 3.0% by mass or less of Zn, 0.3% by mass or less of In, 0.3% by mass or less of Sn, 0.25% by mass or less of Cu, 0.1% by mass or less of Ti, and 0.1% by mass or less of Zr, and further optionally comprising at least one selected from the group consisting of Ni, Cr, and Co, in an amount of 0.2% by mass or less, with the balance being Al and inevitable impurities, wherein 80% or more of the surface area, as viewed from the surface layer of the fin plane, is occupied by recrystallized grains with a length of 10 mm to 80 mm, in a direction rolled.

4. The aluminum alloy fin material for brazing as claimed in claim 3, wherein 85% or more of the surface area, as viewed from the surface layer of the fin plane, is occupied by recrystallized grains with a length of 10 to 80 mm, in the direction rolled.

* * * * *